United States Patent [19]

Gilbertson

[11] Patent Number: 5,054,261

[45] Date of Patent: Oct. 8, 1991

[54] CAP CHUCKS FOR USE WITH BOTTLE CAPPING MACHINES

[76] Inventor: Donald J. Gilbertson, 4167 Vinburn Rd., De Forest, Wis. 53532

[21] Appl. No.: 588,467

[22] Filed: Sep. 26, 1990

[51] Int. Cl.[5] ..... B67B 3/20; B65B 7/28; B65B 59/00

[52] U.S. Cl. ..... 53/331.5; 53/317

[58] Field of Search ..... 53/485, 490, 317, 331.5, 53/367, 201, 368

[56] References Cited

U.S. PATENT DOCUMENTS

| | | | |
|---|---|---|---|
| 1,208,529 | 12/1916 | Evans | 53/317 X |
| 1,856,827 | 5/1932 | Carruthers | 53/317 |
| 1,860,954 | 5/1932 | Risser | 53/317 X |
| 2,034,878 | 3/1936 | Podel | 53/317 |
| 2,656,084 | 10/1953 | Filander | 53/331.5 |
| 2,660,355 | 11/1953 | Allen | 53/485 |
| 2,760,391 | 8/1956 | Knutson | 53/317 X |
| 3,913,301 | 10/1975 | Keller et al. | 53/331.5 |
| 4,364,218 | 12/1982 | Obrist | 53/331.5 |

*Primary Examiner*—Horace M. Culver
*Attorney, Agent, or Firm*—Richard C. Litman

[57] ABSTRACT

Improved bottle capping chucks are disclosed which are compatible with existing bottle capping machines especially screw capping machines. The chucks define frusto-conical throat surfaces with specially selected taper angles which directly contact and grip the bottle cap. The chucks are designed to assure that no slippage occurs even when twisting torque is applied in screwing a cap onto a bottle at high speed operation. The chucks are of one-piece construction with no moving parts and provide excellent wear and deterioration resistance. The chuck will also accommodate screw caps with upward extending applicator type spouts. A range of chucks of various dimensions will accommodate a range of cap diameters. In a second embodiment of the invention a combination chuck is disclosed which defines a plurality of concentric frusto-conical throat surfaces of successively smaller diameters. This combination chuck can accommodate a wide range of cap diameters and cap and bottle shapes.

7 Claims, 2 Drawing Sheets

CAP CHUCKS FOR USE WITH BOTTLE CAPPING MACHINES

FIELD OF THE INVENTION

The invention relates to capping chucks for bottle capping machines.

BACKGROUND OF THE INVENTION

The present invention relates to apparatus for applying caps to bottles especially those which are screwed on to a bottle or similar article. More particularly, the invention relates to improved chucks for use with existing screw capping machines.

There are a number of bottle capping machines currently used in applying screw caps onto bottles. In general, these machines employ a reciprocating mechanism to reciprocate a screw cap applying spindle assembly through a capping cycle. A screw cap chuck is attachable to the spindle assembly. The machines operate with a fixed and predetermined downward pressure and permit a predetermined twisting torque to be applied to the screw cap. Both the downward pressure and the torque are adjustable. Further, the machines are usually height adjustable to accommodate a range of bottle heights.

There are a number of applications for such machines where high speed production and controlled torque screw capping is required. One such application is in the pharmaceutical industry in which items such as dyes, stains, and culture media are packaged in screw cap bottles or screw cap test tubes which must be torqued to precise values.

The machines currently in use employ capping chucks (also referred to as capping shells) which form a generally cylindrical throat surface. The chucks are typically constructed of aluminum or similar light material and a resilient sleeve of rubber or similar material is insertable into the chuck throat. It is this resilient sleeve which actually contacts and grips the screw cap.

In high speed operation, this resilient sleeve is subject to rapid wear and deterioration. This can result in slippage so that the incorrect twisting torque is applied to the screw cap necessitating frequent readjustment of the torque setting. Additionally, as the sleeve deteriorates further, flaking off of the sleeve material can occur. This is unacceptable, especially in an application such as pharmaceutical packaging where an uncontaminated environment is required. Therefore, the resilient sleeve inserts in the capping chucks must be replaced frequently, resulting in high machine downtime and lower productivity.

Additionally, with this resilient sleeve, the amount of torque which can be applied to a bottle cap is limited before slippage of the cap against the sleeve insert occurs. The smaller the bottle cap diameter, the less torque can be applied through this resilient sleeve insert. This can be especially noticeable in applications such as pharmaceuticals where the bottle or test tube may have been exposed to heat in sterilizing procedures, which may in turn require that a higher torque value be applied to achieve secure screwing of the cap onto the bottle or tube.

DESCRIPTION OF THE RELATED ART

U.S. Pat. No. 4,314,723 discloses an apparatus which utilizes a conically tapered internal surface as gripping means for applying screwing torque to an object. However, no prior art has successfully applied this concept to bottle capping and especially to controlled torque screw capping..

U.S. Pat. No. 1,598,392 discloses a bottle screw capping machine employing a cone shaped chuck. However, the inside conical surface does not directly contact the screw cap. Rather, the chuck uses a complex arrangement of moving parts to actually contact and grip the bottle cap.

U.S. Pat. No. 2,696,940 discloses a bottle capping machine with a reciprocating spindle assembly to apply screw caps. The machine operates with a fixed and preadjustable downward pressure and applies an adjustable, predetermined torque to the screw cap. The machine is height adjustable to accommodate a range of bottle heights. Torque is controlled by an adjustable torque clutch. The capping shell or chuck has a threaded recess to screw onto a threaded stud on the clutch housing. A resilient sleeve insert fits into the generally cylindrical chuck throat and it is this resilient sleeve that actually contacts and grips the screw cap.

SUMMARY OF THE INVENTION

By the present invention, improved capping chucks are provided for use with bottle capping machines especially screw capping machines. The chucks of the invention solve several long recognized problems. Previous art devices have been constrained to use capping chucks with moving parts which are expensive and subject to frequent breakdown or chucks employing flexible materials which are subject to rapid wear and deterioration to grip bottle caps especially in high speed screw capping operation. The chucks of the invention are of one piece design with no moving parts and are constructed of a durable material of high wear and deterioration resistance. The chucks are provided with a tapered frusto-conical throat for directly engaging and gripping the screw caps. It has been found that the combination of a carefully selected taper angle with the downward pressure of the capping machine's spindle assembly assures secure gripping of the screw cap without slippage. This design, therefore, obviates the need for separate resilient inserts or complex arrangements of moving parts which are subject to rapid wear and deterioration and result in increased machine downtime.

Because of the frusto-conical configuration of the chuck throat, a range of cap diameters can be accommodated. The chucks can be constructed in a range of sizes to accommodate diverse bottle cap diameters and bottle shapes from those with relatively wide shoulders, to those of a more tubular configuration such as test tube type containers and those with upward extending protuberances such as screw caps with built in applicator spouts.

In a second embodiment of the invention, a plurality of frusto-conical throat sections are arranged in a stepped or concentric configuration of successively smaller diameters. This embodiment allows each chuck to accommodate a larger range of screw cap diameters.

Accordingly one of the objects of the present invention is to provide a chuck for a bottle capping machine which is of one-piece construction, has no moving parts, and which has a throat surface which directly contacts and grips the bottle cap.

It is another object of the invention to provide an improved chuck adaptable to current bottle capping machines.

It is a further object of the invention to provide a chuck for a bottle capping machine which is constructed of durable material, which is highly resistant to wear and deterioration, and which firmly grips the bottle cap without slippage even at high speed operation and where twisting torque is applied to screw the cap onto the bottle.

It is yet another object of the invention to provide a chuck for a bottle capping machine which can accommodate a wide range of bottle and cap shapes and sizes.

With these and other objects in view which will more readily appear as the nature of the invention is better understood, the invention consists in the novel combination and assembly of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

The cap chucks of the invention are of one-piece design constructed so that the throat surface of the chuck directly contacts and grips the bottle cap. The chucks of the invention were specifically designed for screw capping machines which impart controlled twisting torque through the chuck to screw the cap onto the bottle. The machines are typically either electrically or pneumatically powered. However, it will be readily apparent that they can function equally well for other types of bottle capping machines such as those for push-on caps. It has been found that the combination of a carefully selected taper angle with the downward pressure of a bottle capping machine's spindle assembly assures secure gripping of the bottle cap without slippage even during high speed operation. The angle of the throat taper is carefully selected. If the angle is too steep, or too shallow slippage can occur. Additionally, the incorrect angle can reduce the range of cap sizes that can be accommodated, can cause a bottle cap to get jammed in the chuck resulting in machine downtime, and can increase the possibility of bottle breakage.

Figure 1:
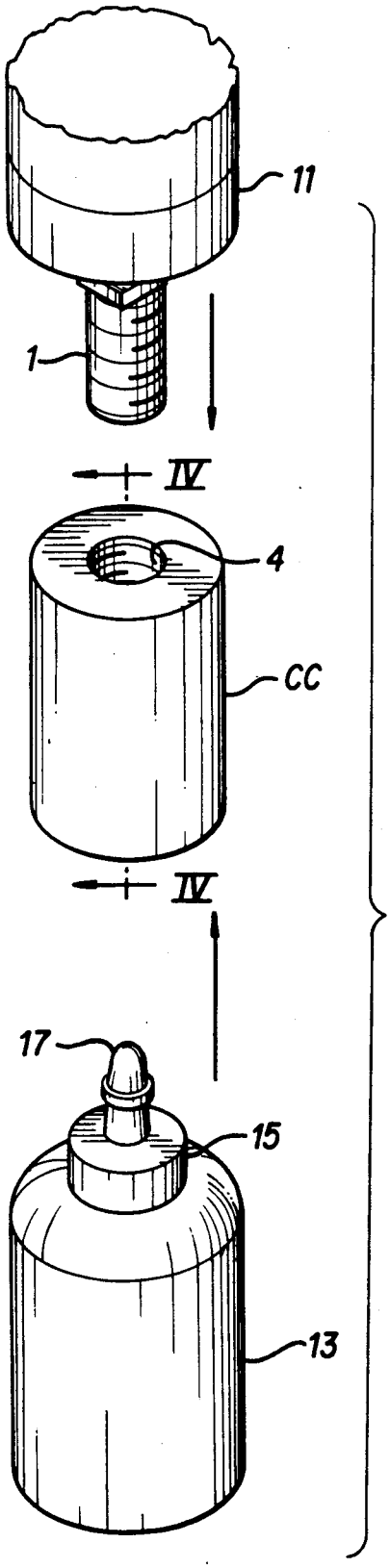
FIG. 1 is an exploded perspective view of the invention shown in relation to the threaded mounting stud on the screw cap bottling machine and to a sample screw cap bottle.

Referring now to FIG. 1 of the drawing, the second embodiment of the chuck of the invention CC is shown in relationship to the threaded mounting stud 1 of a screw capping machine typically located on the machine's clutch housing 11. A typical bottle 13 and screw cap 15 are also shown.

Figure 2:
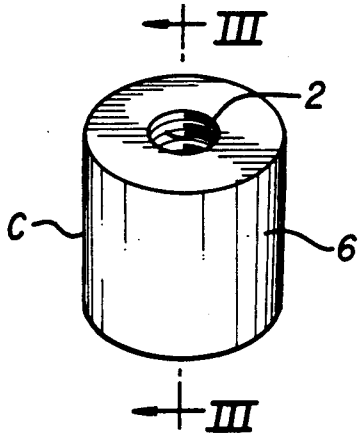
FIG. 2 is a top perspective view of the first embodiment of a cap chuck in accordance with the present invention.

Referring now to FIG. 2, a top perspective view of the invention is shown illustrating the invention's female threaded recess 2 for attachment to the threaded mounting stud on the screw capping machine 1.

Figure 3:
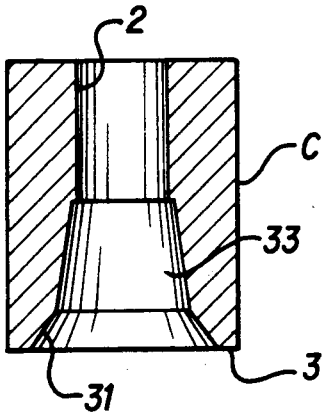
FIG. 3 is a cross sectional view taken along the line III—III of FIG. 2 of the first embodiment of a cap chuck in accordance with the present invention.

Referring now to FIG. 3, a cross sectional view of a chuck of the first embodiment C of the invention is shown. The upper threaded area 2 of the chuck throat is shown in cross section adjacent the top face 8 of the chuck body.

The chuck throat opening at the bottom chuck face 3 presents a flared surface 31 to accommodate a larger range of bottle shoulder widths. Throat surface 33 is of tapered configuration and is the cap gripping element of the chuck. As can be seen, the frusto-conical configuration will allow the chuck to grip a range of screw cap diameters.

Figure 4:
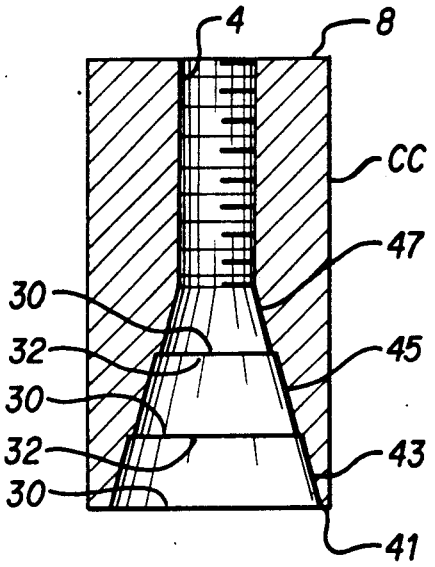
FIG. 4 is a cross sectional view taken along the line IV—IV in FIG. 1 of the second embodiment of a cap chuck in accordance with the present invention.

Referring now to FIG. 4, there is shown the second embodiment of the chuck of the invention. Details of the upper threaded area 4 of the chuck throat is shown in cross section. This design is identical to the threaded segment 2 of the first embodiment in FIG. 3. As can be seen a multiple thread pattern is illustrated so that the chuck is compatible for mounting on several models of screw capping machines. Two examples of compatible screw capping machines are the Cap Master manufactured by Automation Devices Inc. of Fairfield, Pa., originally covered by U.S. Pat. No. 2,696,940, and the Bio-Med, Model M-3000C manufactured by Apco Technologies of Vancouver, Wash.

Although, in the preferred embodiments herein described, the chucks are threadable onto existing mounting studs on screw capping machines, it will be understood that the chucks of the invention can be adapted to incorporate other mechanisms for mounting to diverse bottle capping machines.

While the chuck C of the first embodiment of the invention as shown in FIG. 3 has a single continuous gripping throat 33, the combination chuck CC of the second embodiment as shown in FIG. 4 provides a gripping throat comprised of, for example, three stepped successive, immediately adjacent frusto-conical areas or segments 43, 45, and 47. The lower throat segment 43 begins at chuck bottom face 41 and continues to the second throat surface 45. It will be understood that the lowermost diameter of throat segment 45 is a stepped reduction in diameter from the uppermost diameter of throat segment 43 rather than a continuous reduction. The third uppermost throat segment 47 likewise represents a stepped diameter reduction from throat segment 43. Each segment surface includes a lower edge 30 and an upper edge 32. In this embodiment of the chuck of the invention, therefore, a greater range of bottle cap diameters can be accommodated for a chuck with given throat depth than would be possible in the continuous taper throat represented in FIG. 3.

However, the chucks C of the first embodiment as shown in FIG. 3 with a single continuous gripping throat 33, also can accommodate a range of bottle cap diameters. Additionally, the chucks C of the first embodiment are preferred in applications where clearance between the mounting stud located on the bottle capping machine's spindle assembly and the top of the bottle to be capped is limited. This has been observed to be the case with some of the commonly used bottle capping machines when capping small tubes or bottles. As an example, three individual chucks C of the first embodiment, representing each of the throat segments 43, 45, and 47 as shown in FIG. 4 of the combination chuck CC of the second embodiment, are preferred for such an application.

Figure 5:
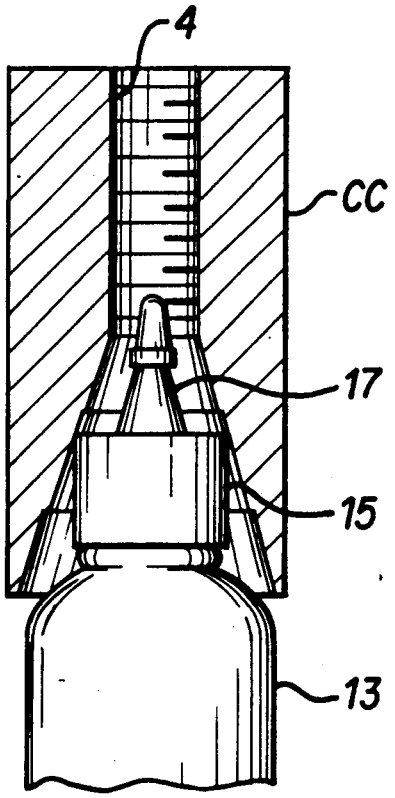
FIG. 5 is the cross-sectional view as in FIG. 4 illustrating a screw cap bottle engaged by the invention.

Referring now to FIG. 5, there is illustrated the greater overhead clearance provided by the chucks CC of the second embodiment of the invention. This allows the chuck CC to accommodate a screw cap with an upwardly thrusting protuberance 17, as first illustrated in FIG. 1, such as a bottle cap with a built-in applicator spout.

The operation of the chucks of the invention is straightforward. The chuck is mounted on the screw capping machine. The machines are typically either electrically or pneumatically powered. The chuck is forced down over the screw cap and bottle with a predetermined downward pressure until the chuck throat surface grips the screw cap. The chuck then rotates, screwing the cap on the bottle to the torque value preset on the screw capping machine.

The cap chuck of the invention can be constructed of any durable material of high wear and deterioration resistance. The cap chucks of the preferred embodiment of the invention were milled from stainless steel.

Dimensions of the chucks will vary to accommodate the desired range of cap diameters and cap and bottle shapes. however, as indicated previously, it has been found that the throat taper angle must be carefully selected. As an example, referring again to FIG. 4, a combination chuck CC, with three concentric, stepped, frusto-conical throat surfaces was constructed with the following dimensions:

a. Overall length: 2.175 inches,
b. Outside diameter: 1.375 inches,
c. Diameter at the throat opening: 1.090 inches,
d. Range of diameters for first throat surface 43: 1.090 to 0.951 inches,
e. Depth of first throat surface 43: 0.305 inches,
f. Range of diameters for second throat surface 45: 0.906 to 0.752 inches,
g. Depth of the second throat surface 45: 0.600 inches,
h. Range of diameters for the third throat surface 47: 0.713 to 0.611, and
i. Depth of the third throat surface, 47—0.375 inches.

This combination chuck can, therefore, accommodate bottle caps from 16 to 27 millimeters in diameter and with a variety of cap and bottle configurations.

It will be readily apparent that three individual chucks C of the first embodiment of the invention as shown in FIG. 3 can be constructed with throat 33 dimensions corresponding to the dimensions of each of the throat segments 43, 45, and 47 shown in FIG. 4 of the combination chuck CC described above.

It is to be understood that the present invention is not limited to the sole embodiments described above, but encompasses any and all embodiments within the scope of the claims.

I claim:

1. A bottle capping chuck comprising;

an elongated unitary body of rigid material having a longitudinal axis and provided with a central throat, attachment means along said body axis adapted to engage a motion delivery tool, said body having a top face adjacent said attachment means and a bottom face adjacent said throat, said throat defined by immediately serially adjacent first, second and third frusto-conical areas each comprising an inclined surface having a lower edge and an upper edge, said frusto-conical areas having successively smaller diameters beginning with said first area adjacent said bottom face and extending toward said top face, said inclined surface upper edge of said first and second frusto-conical areas defining a greater diameter than said lower edge of said inclined surface of said second and third frusto-conical areas respectively, and said inclined surfaces comprising an integral part of said unitary body of rigid material, whereby a plurality of abutting inwardly stepped tapered surfaces are defined by said inclined surfaces adapted to accommodate a substantial variety of cap diameters.

2. A bottle capping chuck according to claim 1 wherein, the diameter of said first frusto-conical inclined surface ranges substantially between 1.090–0.951 inches.

3. A bottle capping chuck according to claim 1 wherein, the diameter of said second frusto-conical inclined surface ranges substantially between 0.906–0.752 inches.

4. A bottle capping chuck according to claim 1 wherein, the diameter of said third frusto-conical inclined surface ranges substantially between 0.713–0.611 inches.

5. A bottle capping chuck according to claim 1 wherein, said attachment means includes a threaded bore.

6. A bottle capping chuck according to claim 1 wherein, the axial extent of said first, second and third frusto-conical area inclined surfaces is substantially 0.305, 0.600 and 0.375 inches.

7. A bottle capping chuck according to claim 1 including, a clearance along said body axis adapted to accommodate bottle caps having an upwardly disposed protuberance.

* * * * *